US007377289B1

(12) United States Patent
English et al.

(10) Patent No.: US 7,377,289 B1
(45) Date of Patent: May 27, 2008

(54) HOSE REEL

(75) Inventors: Stephen T. English, Englewood, OH (US); John R. Grishaber, Mt. Wolf, PA (US); Eric K. Fasser, Clifton Park, NY (US)

(73) Assignee: Ames True Temper, Inc., Camp Hill, PA (US)

( * ) Notice: Subject to any disclaimer, the term of this patent is extended or adjusted under 35 U.S.C. 154(b) by 172 days.

(21) Appl. No.: 11/385,206

(22) Filed: Mar. 21, 2006

(51) Int. Cl.
*A01M 7/00* (2006.01)

(52) U.S. Cl. ..... 137/355.2; 16/429; 242/284

(58) Field of Classification Search ..... 137/355.16, 137/355.2; 16/429; 242/284
See application file for complete search history.

(56) References Cited

U.S. PATENT DOCUMENTS 1,499,644 A 7/1924 Dowrelio
2,640,661 A * 6/1953 Lee ..... 242/284
4,537,215 A 8/1985 Roman
D289,492 S 4/1987 Clivio et al.
5,443,570 A * 8/1995 Hirano ..... 242/284
6,050,291 A 4/2000 Whitehead et al.
6,450,063 B1 * 9/2002 Harvey et al. ..... 16/429
6,640,389 B2 * 11/2003 Van Klompenburg et al. ..... 16/429
6,792,970 B2 9/2004 Lin
7,003,849 B2 * 2/2006 Cohen et al. ..... 16/429
7,017,603 B1 * 3/2006 Rosine et al. ..... 137/355.2

* cited by examiner

*Primary Examiner*—John Fox
(74) *Attorney, Agent, or Firm*—David C. Jenkins; Eckert Seamans Cherin & Mellott; LLC

(57) ABSTRACT

The present invention provides for a hose reel assembly structured for ease of use and maintenance. The hose reel assembly includes a folding crank handle, having an easily accessible and identifiable release, an easily released water system, and an autotrack device that is easily engaged/disengaged. By improving the ease of use of such components, the amount of wear and tear on the hose reel is reduced and the life of the hose reel is extended.

17 Claims, 15 Drawing Sheets

HOSE REEL

BACKGROUND OF THE INVENTION

1. Field of the Invention

This invention relates to hose reels and, more specifically, to a hose reel structured for ease of use and maintenance.

2. Background Information

Hose reel assemblies are devices structured to assist in transporting and using hoses, typically garden hoses for dispensing water. Generally, the hose reel assembly includes a base or housing assembly structured to rotatably support a reel, or "basket assembly." The basket assembly's primary components are a barrel, around which an outlet hose is wrapped, two hubs which are coupled to the housing assembly, and guide plates which define the usable area of the barrel. The basket assembly also includes a crank, used to turn the basket primary components, and a water conduit having a movable outlet and a generally stationary inlet. The stationary inlet of the conduit extends away from the reel and is structured to be coupled to a supply hose which is further coupled to a water supply. The movable outlet of the conduit is disposed on the circumference of the reel. The outlet hose is coupled to the movable outlet and is used to deliver water to the end use. Hose reel assemblies also may include an autotrack device structured to wind the outlet hose on the reel in a controlled manner. In this configuration, an outlet hose may be coupled to the movable end of the conduit and, when the reel is rotated, the hose is wrapped, or unwrapped, about the reel. Thus, a hose may be transported and/or stored on the hose reel assembly.

The hose reel assembly typically is made of plastic and sold in a disassembled state. While manufactures try to make the assembly of a typical hose reel relatively simple, there are many components of a hose reel assembly that are difficult for some users to install or assemble. As such, manufactures try to include as many preinstalled components as possible. The disadvantage to having preinstalled components, however, is that some components, especially those like the crank handle that extend away from the body of the hose reel, require additional room in the shipping container and/or storage box. Accordingly, some manufactures have devised structures that are partially collapsible, such as a folding crank handle, that reduce the volume/size of the hose reel during shipping. Unfortunately, these structures are also designed to snap into an extended position and not be collapsed again, or, if structured to be collapsible, the crank handles did not provide easy to access to, or identify, release buttons. This situation created other disadvantages, namely users causing wear and tear to the plastic components by forcing the components into the desired configuration.

Another component that has been traditionally subject to wear and tear is the autotrack device. The autotrack device is used to guide the hose as the hose is being wound about the basket. The autotrack device includes two spaced, parallel rods, wherein one rod includes a bi-directional track, and a follower assembly. The follower assembly engages the track and, as the user rotates the basket using the crank, the follower assembly moves back and forth on the two rods. The hose passes through the follower assembly and, as such, the hose is wrapped around the basket in a controlled manner. As the autotrack device is only required during winding of the hose, manufacturers typically structured the autotrack device to be engaged only during the winding of the hose and disengaged during unwinding. This procedure reduces wear and tear on the autotrack device as the autotrack device is only in limited use. Many users, however, have found the present design of the autotrack device release to be difficult to operate. As such, the users will simply leave the autotrack device engaged at all times, thereby increasing the wear and tear.

Additionally, users are also known to have difficulty in disassembling, or at least partially disassembling, the hose reel assembly as is required for certain maintenance operations, such as accessing the water system for lubrication. That is, in the prior art, the water system included a conduit having a generally stationary inlet and a movable outlet. The generally stationary inlet is coupled to the hose reel assembly housing assembly, and has a generally circular pipe extending into the reel. The water system also included a rotating outlet, coupled to the reel, and having a wide diameter pipe extending into the reel. The inlet pipe extended into the outlet pipe. The inlet pipe disposed in the outlet pipe creates the water system conduit. An O-ring, or other sealing device, is disposed at the interface between the inlet and the outlet pipes to resist water leaking therefrom. A user typically needed to substantially disassemble the water system, using tools, for such simple maintenance operations as lubricating the water system O-rings. As such, the maintenance procedures are time consuming and difficult and users simply failed to perform the required maintenance, furthering degradation due to wear and tear.

As such, there is a need for a hose reel that is structured for easy assembly and maintenance.

There is a further need for a hose reel assembly having an easily collapsible crank handle.

There is further need for a hose reel assembly having an easily accessible water system.

There is a further need for a hose reel assembly having an easily engaged/disengaged autotrack device.

SUMMARY OF THE INVENTION

These needs, and others, are met by the present invention which provides for a hose reel assembly structured for ease of use and maintenance. The hose reel assembly includes a folding crank handle, having an easily accessible and identifiable release, an easily released water system, and an autotrack device that is easily engaged/disengaged. By improving the ease of use of such components, the amount of wear and tear on the hose reel is reduced and the life of the hose reel is extended. The crank includes a crank arm and a pivotable handle assembly. The handle assembly includes at least one, and preferably two, locking tabs disposed adjacent to the pivot point. The crank includes at least one, and preferably two, finger notches adjacent to the locking tabs. The finger notches provide easy access to the locking tabs when the handle is in the extended position. The locking tabs are flexible tabs that engage the crank arm when the handle is in the extended position. The locking tabs may be released by biasing the tabs away from the crank ann. Moreover, as users are familiar with the shape of the finger notches, users will quickly learn to use the release feature of the locking tabs thereby allowing the handle to pivot freely.

The autotrack device is improved with an easily operable release lever assembly on the follower. The release lever assembly is coupled to the follower housing and includes a lever member, a track engaging member, and a spring. As is known, the autotrack device also includes a rod, or guide bar, having a bi-directional track The track engaging member is an elongated member having one end coupled to the housing, via the lever, and the other end having a tooth structured to selectively engage the guide bar. The spring extends between the housing and the track engaging member and is structured to bias the track engaging member toward the guide bar. The lever member has a grip portion and a cam portion. The grip portion is a generally flat, substantially solid element. The cam portion is a bifurcated yoke wherein the tines have lateral edges which extend outwardly, in both directions, from the plane of the grip portion. The yoke supports an offset support rod. The track engaging member is coupled to the support rod. The lever member is pivotally coupled to the housing. In this configuration, the lever member may be placed in a first or second position. In a first position, the offset rod is located closer to the housing, in the second position wherein the lever member is pivoted about 180 degrees on the housing, the offset rod is spaced from the housing. As the track engaging member is coupled to the offset rod, when the lever member is in the first position, the spring biases the track engaging member into engagement with the guide bar. In the second position, the track engaging member is spaced from the guide bar and the tooth does not engage the track.

The water system includes a stationary inlet member and a rotating outlet member, as is known in the art. The present invention, however, provides an easy release interlock structured to couple the inlet and outlet members. The interlock includes one or more grooves in the outer surface of the inlet pipe, at least one, and preferably two, openings in the outlet pipe, and a locking member having an elongated handle with a yoke. When assembled, the inlet pipe is disposed partially within the outlet pipe with the grove aligned with the openings. The locking member yoke is disposed through the outlet pipe openings and into the inlet pipe groove. In this configuration, the inlet pipe may not move axially relative to the outlet pipe while the outlet pipe may rotate about the inlet pipe. The locking member handle extends to the edge of the basket assembly where it may be easily grasped. To remove the inlet pipe, a user merely pulls the locking member handle radially away from the pipes, thereby disengaging the yoke. Once the yoke no longer engages the inlet pipe groove, the inlet pipe may be moved axially relative to the outlet pipe. That is, a user may pull the inlet pipe out of the basket assembly and housing assembly. The O-rings are, preferably, disposed on the inlet pipe. Thus, the user may apply lubricant to, or replace, the O-rings without having to access the interior of the housing assembly or basket.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
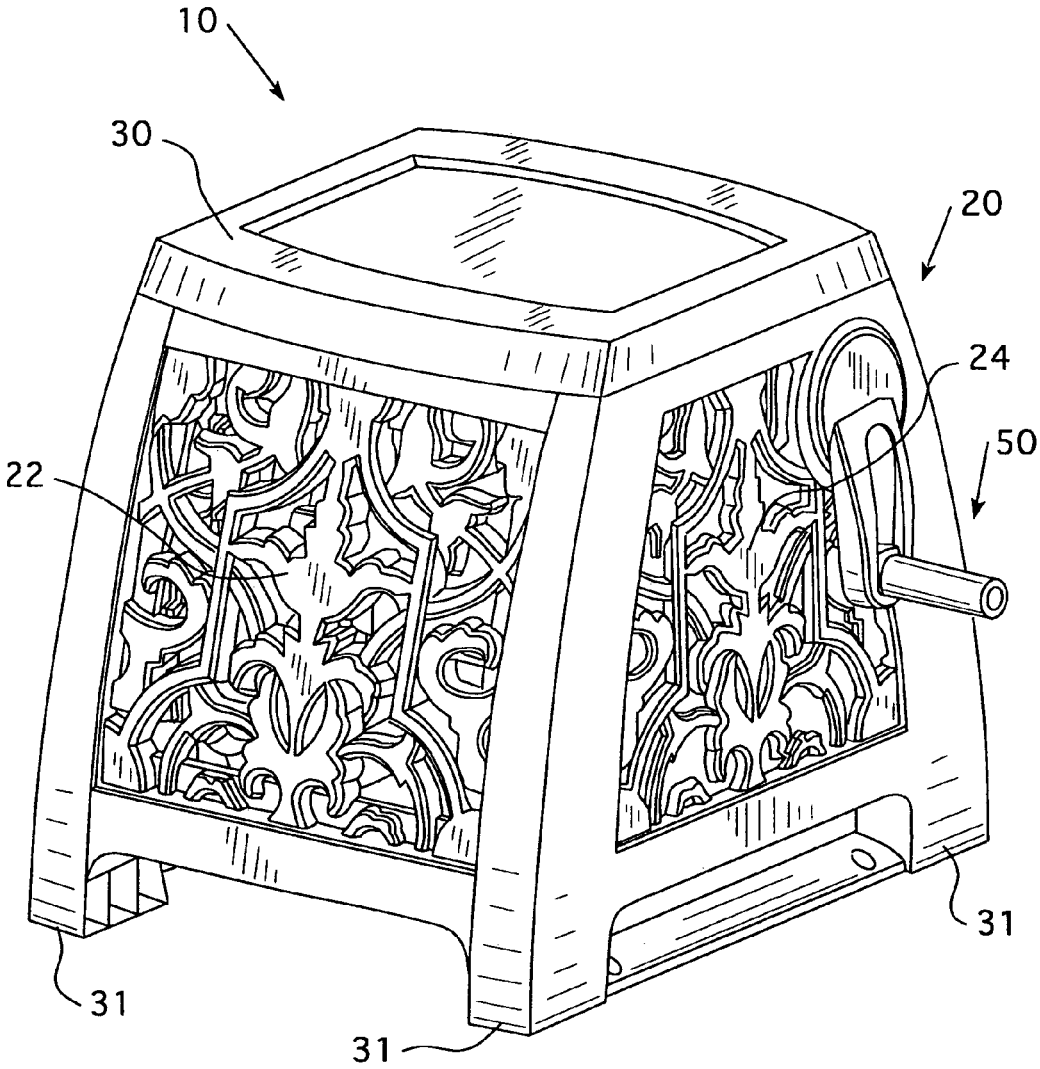
FIG. 1 is an isometric view of a hose reel.
Figure 2:
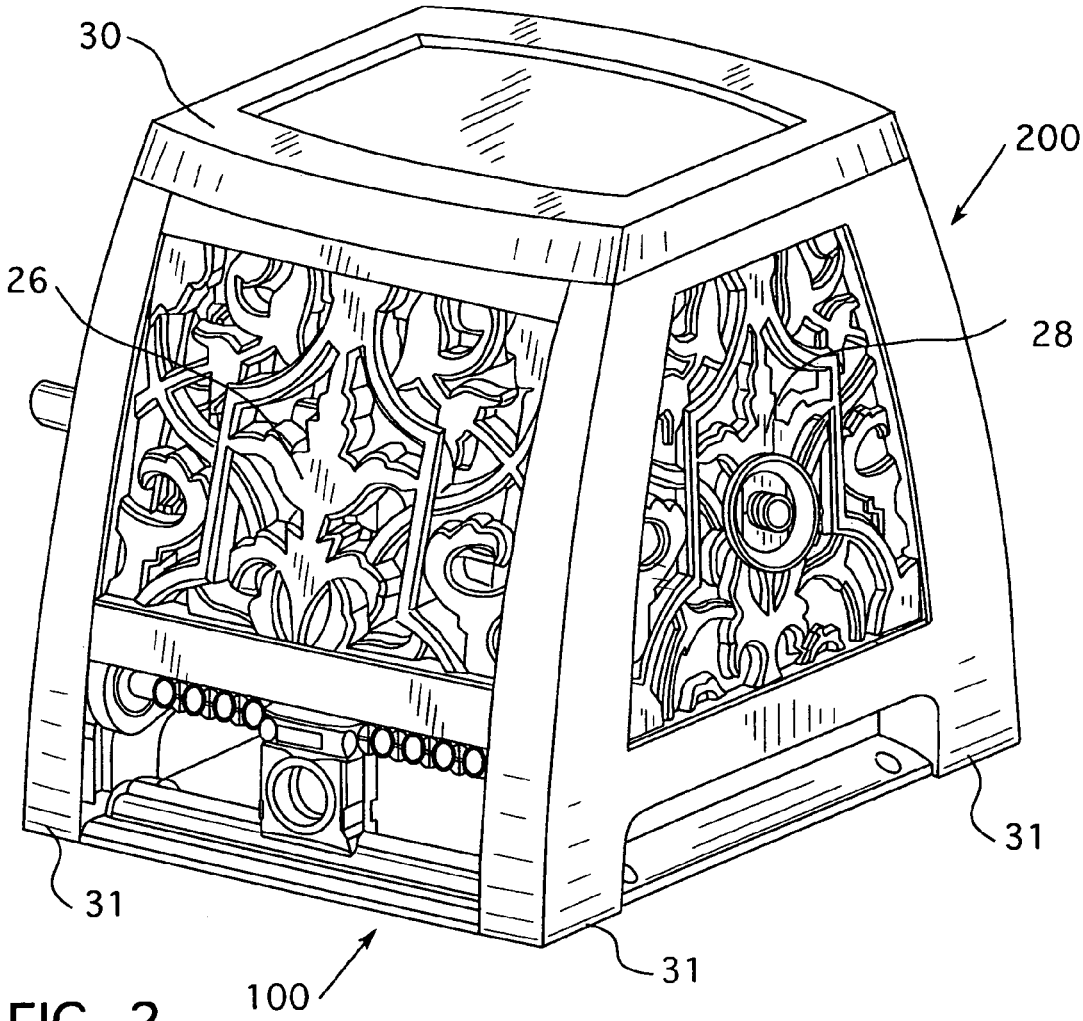
FIG. 2 is another isometric view of a hose reel.

As shown in FIGS. 1 and 2, a hose reel assembly 10 includes a housing assembly 20 and a basket assembly 40. The housing assembly 20, preferably, includes a front side 22, a first lateral side 24 (FIG. 1), a back side 26, a second lateral side 28 (FIG. 2), a top member 30, and an autotrack device 100 (FIG. 2). The front side 22 and the back side 26 are each coupled to the first and second lateral sides 24, 28 and disposed in a spaced, generally parallel configuration. The first and second lateral sides 24, 28 are also disposed in a spaced, generally parallel configuration. Thus, the housing assembly 20 is generally a rectangular shape. A foot 31 is located at each corner of the housing assembly 20. As shown in FIGS. 1 and 2, the front side 22, first lateral side 24, back side 26, and second lateral side 28 may include a decorative pattern. The autotrack device 100 is disposed adjacent to the back side 26 and is discussed in detail below.

Figure 3:
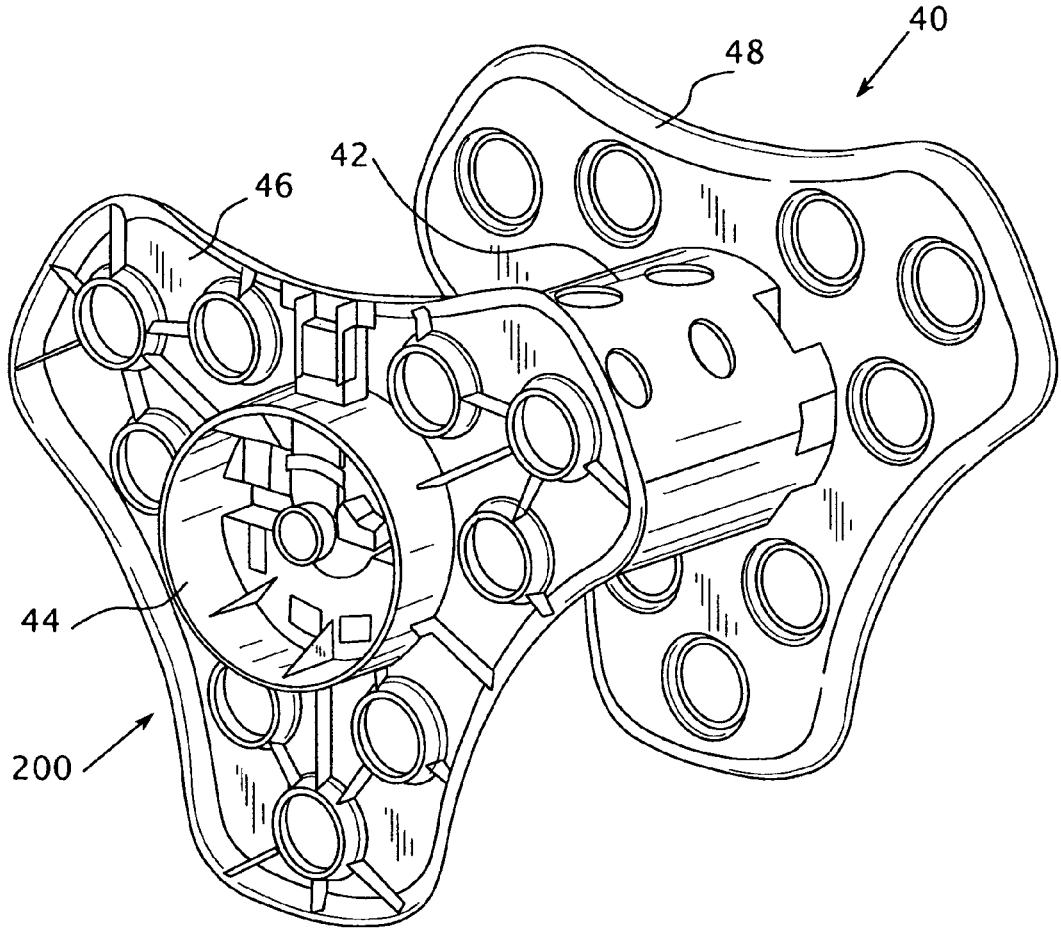
FIG. 3 is an isometric view of a basket assembly.

As shown in FIG. 3, the basket assembly 40 includes an elongated barrel 42 with two axial hubs 44, a crank assembly 50 (FIG. 1), and a water system 200. The basket assembly 40 may also include two guide plates 46, 48. One guide plate 46, 48 is disposed adjacent to each end of the barrel 42. The hubs 44 are rotatably coupled to the housing assembly 20, preferably to the first and second lateral sides 24, 28. In this configuration, the barrel 42 may be rotated about its longitudinal axis while disposed within the housing assembly 20. The crank assembly 50 is coupled to the barrel 42 either directly or via one or more gears and is structured to rotate the barrel 42 within the housing assembly 20.

Figure 4:
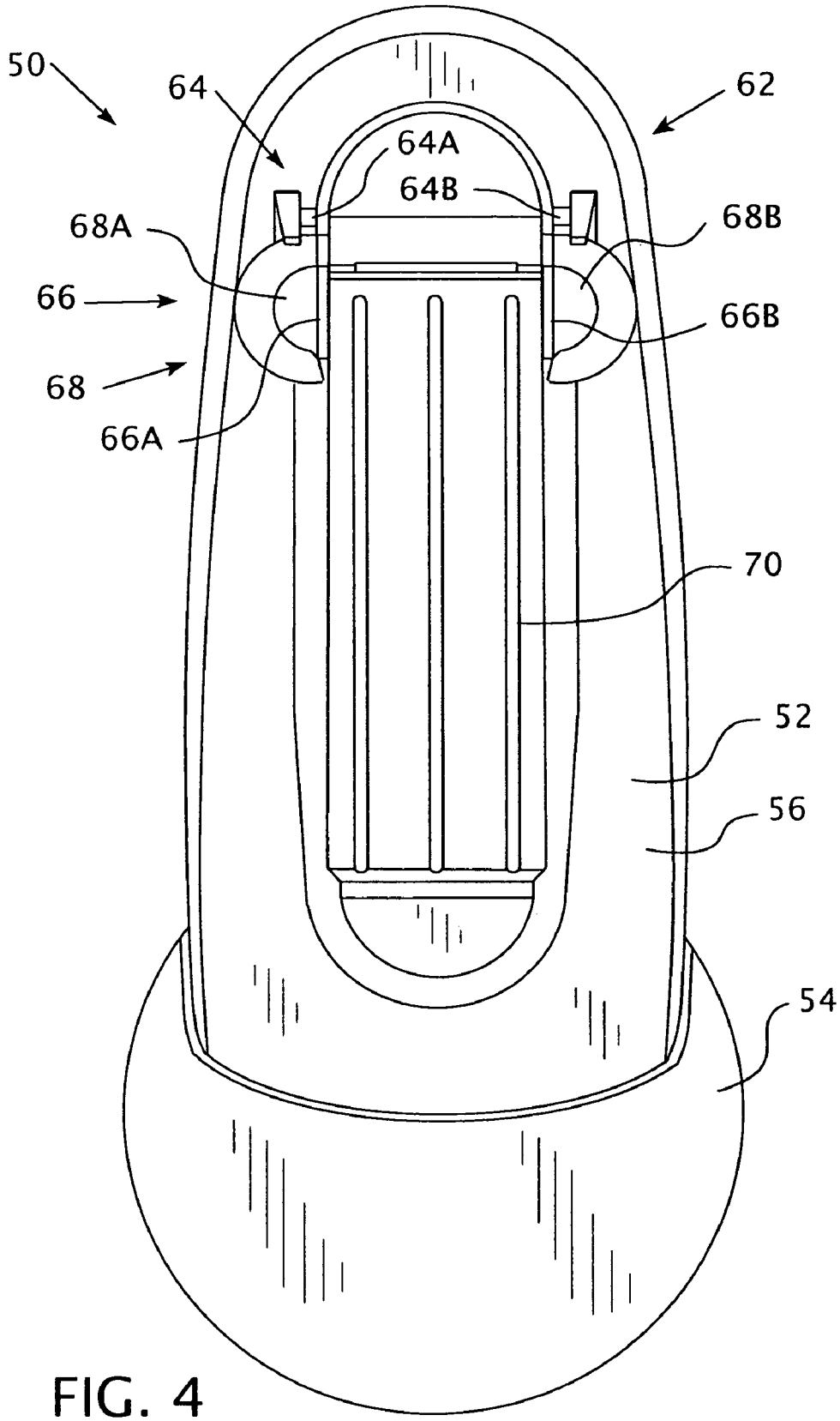
FIG. 4 is a front view of the handle assembly in a first position.
Figure 5:
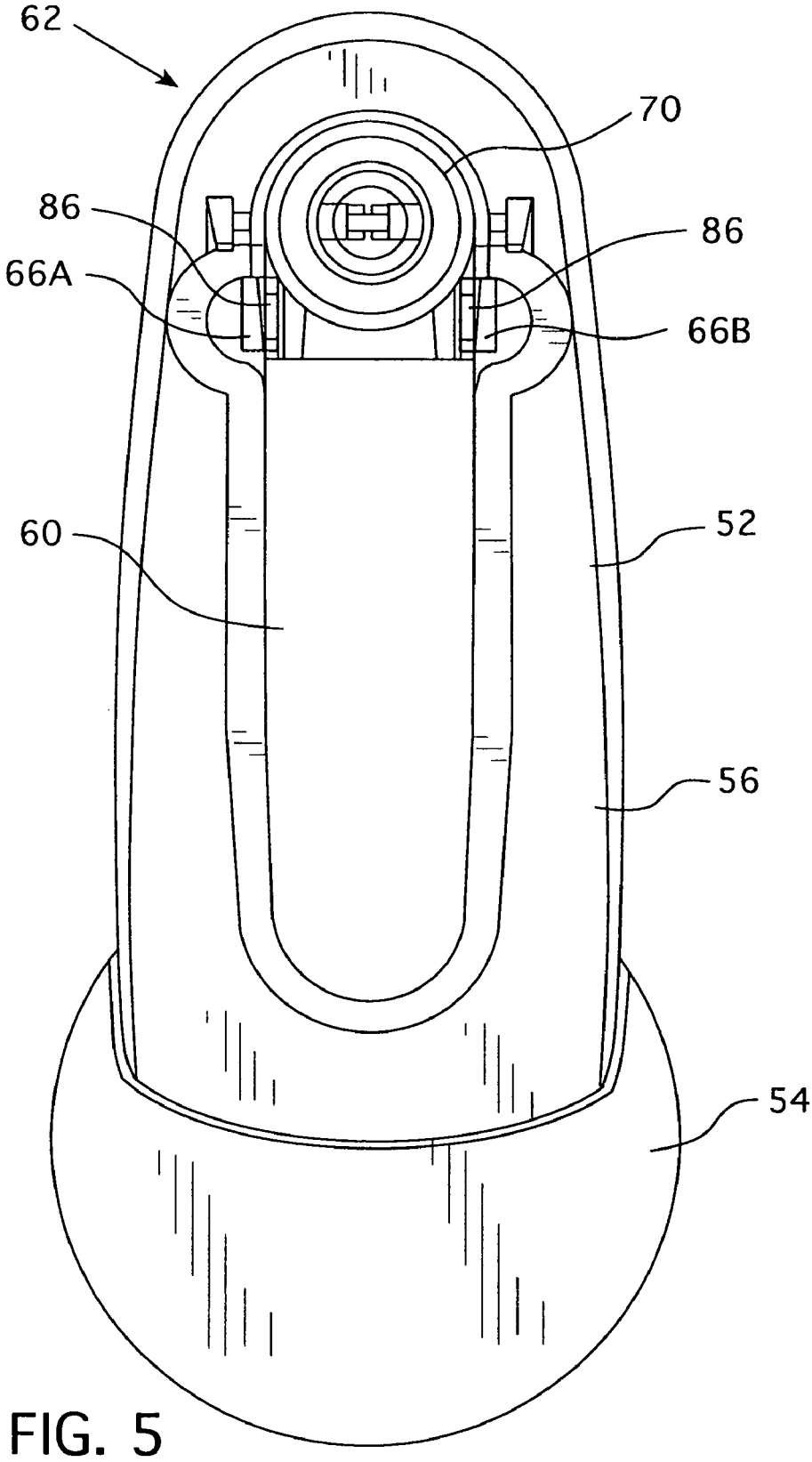
FIG. 5 is a front view of the handle assembly in a second position.

As shown in FIGS. 4 and 5, the crank assembly 50 includes an elongated crank arm 52 and handle assembly 70. The crank arm 52 includes a base portion 54 and an elongated body 56. The base portion 54 has, preferably, an outer disk 58 and an inner coupling device (not shown). The outer disk 58 is structured to be disposed in an opening on the housing assembly 20. The inner coupling device is structured to be coupled to the barrel 42. The body 56 extends, generally, in the same plane as, or a plane parallel to, the base portion 54. The body 56 has a handle pocket 60 (FIG. 3) disposed along the longitudinal axis and a handle receptacle 62 disposed at the distal end of the body 56. The handle receptacle 62 has at least one, and preferably two, pivot openings 64A, 64B and at least one, and preferably two, locking edges 66A, 66B. Each locking edge 66A, 66B is a rigid member extending in a direction generally parallel to the longitudinal axis of the body 56. The handle pocket 60 has at least one, and preferably two, finger notches 68A, 68B disposed adjacent to the locking edges 66A, 66B.

Figure 6:
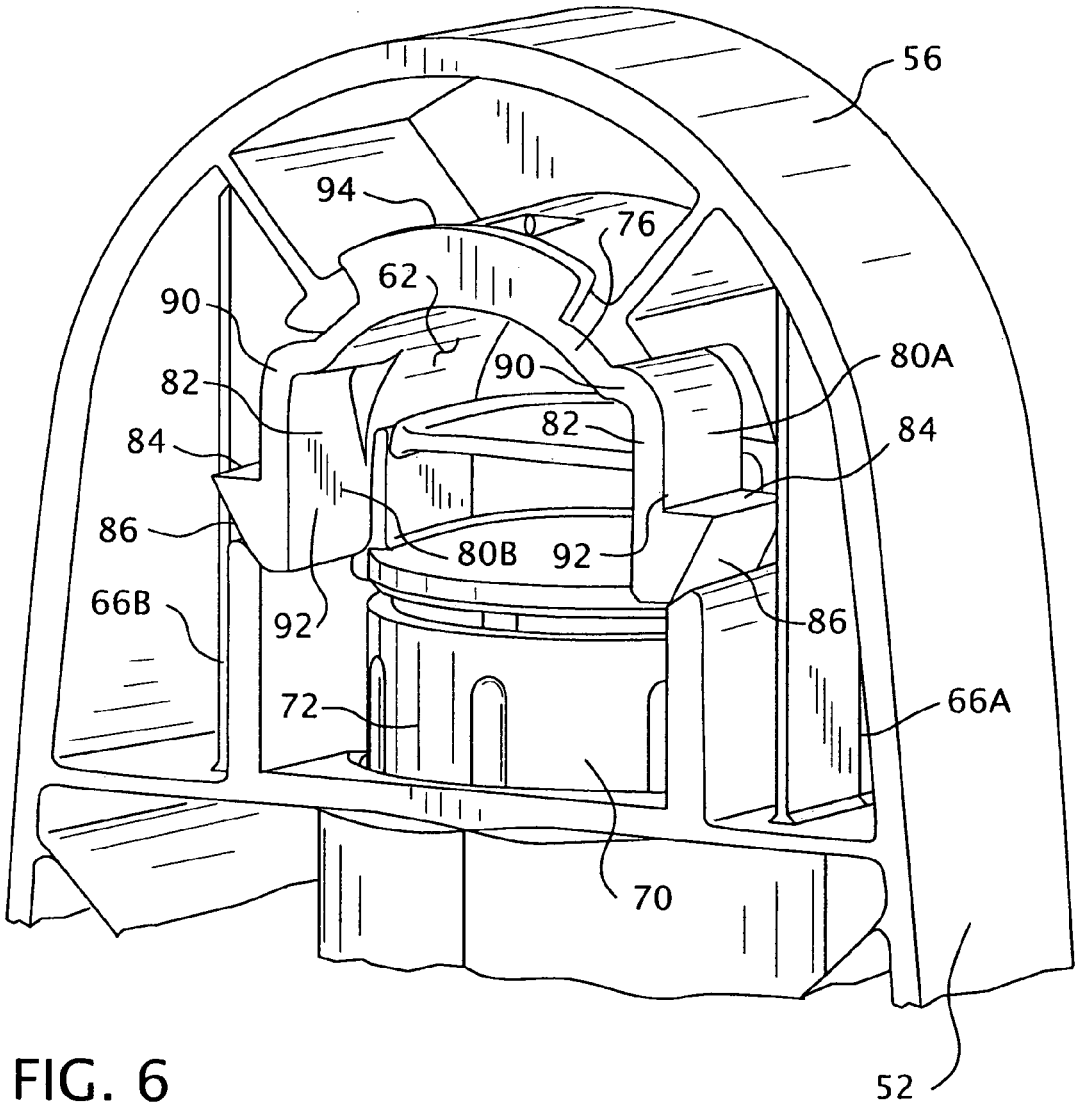
FIG. 6 is a detailed isometric back view of the handle assembly in a first position.
Figure 7:
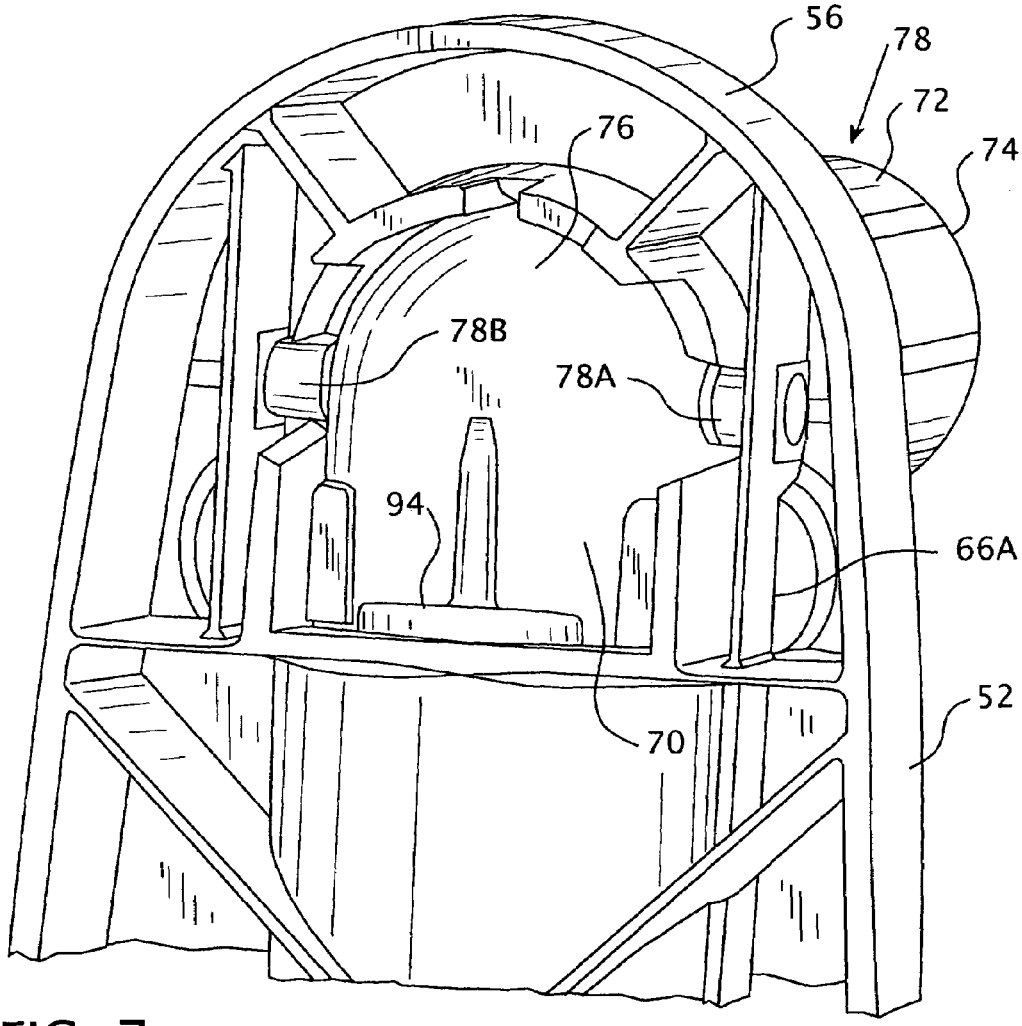
FIG. 7 is a detailed isometric back view of the handle assembly in a second position.

As shown in FIGS. 6 and 7, the handle assembly 70 includes an elongated handle member 72 with a distal end 74 and a receptacle end 76. The handle member 72 is, preferably, a cylindrical member. The receptacle end 76 has at least one, and preferably two, pivot pins 78A, 78B (FIG. 7) as well as at least one, and preferably two, locking tabs 80A, 80B. The pivot pins 78A, 78B extend generally perpendicular to the longitudinal axis of the handle member 72. The locking tabs 80A, 80B include an elongated stem 82, a locking surface 84, and a finger pad 86. Each stem 82 has a first, proximal end 90 and a second, distal end 92. The proximal end 90 is coupled to the handle receptacle end 76. Each stem 82 extends in a direction generally parallel to the longitudinal axis of the handle member 72. Each locking surface 84 and finger pad 86 is disposed adjacent to the handle member distal end 74. Each locking surface 84 extends generally perpendicular to the associated stem 82. The finger pad 86 extends at an angle between each locking surface 84 and associated stem 82. The handle member 72 may also include a stop tab 94. The stop tab 94 is structured to engage the handle receptacle 62 to stop the handle member 72 in the second position, as described below.

When the crank assembly 50 is assembled, the handle assembly 70 is pivotally coupled to the crank arm 52 with the handle assembly pivot pins 78A, 78B disposed in the handle receptacle pivot openings 64A, 64B. In this configuration, the handle assembly 70 is structured to move between a first, folded position, wherein the handle assembly 70 is disposed partially within the handle pocket 60, and a second, extended position wherein the handle assembly 70 extends about ninety degrees to the crank arm 52. Additionally, when the handle assembly 70 is in the second position, each locking tab 80A, 80B engages a locking edge 66A, 66B. That is, as the handle assembly 70 is moved into the second position, the angled finger pad 86 engages the associated locking edge 66A, 66B causing the locking tab 80A, 80B to flex. Once the finger pad 86 moves past the locking edge 66A, 66B, the locking tab 80A, 80B returns to an unflexed position wherein the locking surface 84 engages the associated locking edge 66A, 66B. With the locking surface 84 engaging an associated locking edge 66A, 66B, the handle assembly 70 may not be pivoted. To release the handle assembly 70, a user must apply pressure to the finger pads 86 thereby causing the locking tabs 80A, 80B to flex. Once the locking tabs 80A, 80B are flexed a sufficient amount, the used may again pivot the handle assembly 70 to the first position. The finger notches 68A, 68B are conveniently disposed adjacent to the finger pads 86 when the handle assembly 70 is in the second position. Additionally, the stop tab 94 is structured to engage the crank arm 52 when the handle assembly 70 is in the second position. Thus, the range of motion for the handle assembly 70 is limited.

Figure 8:
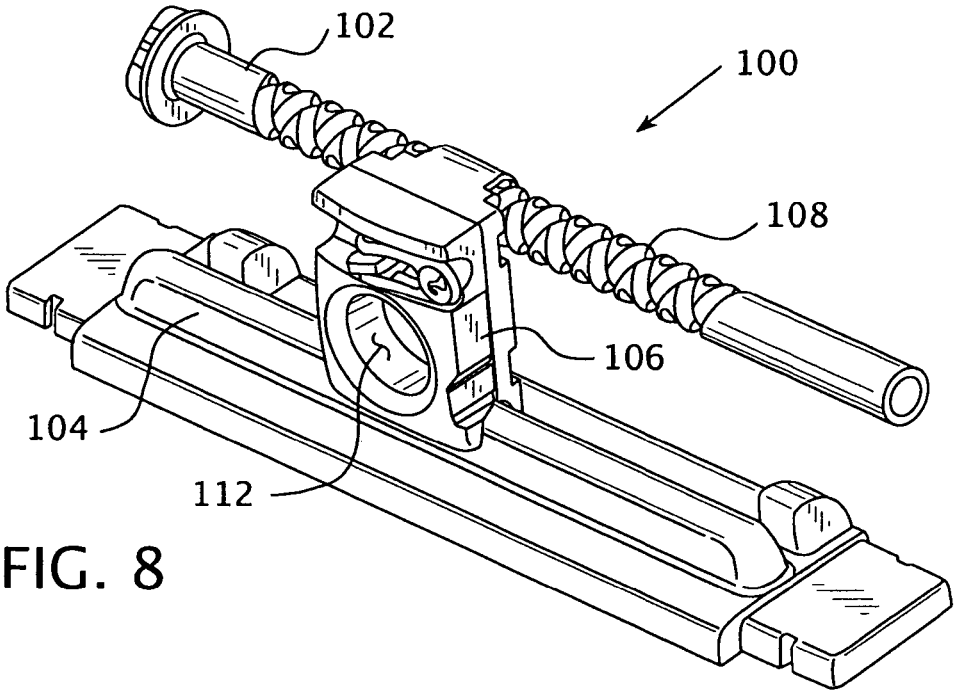
FIG. 8 is an isometric view of an autotrack device.
Figure 9:
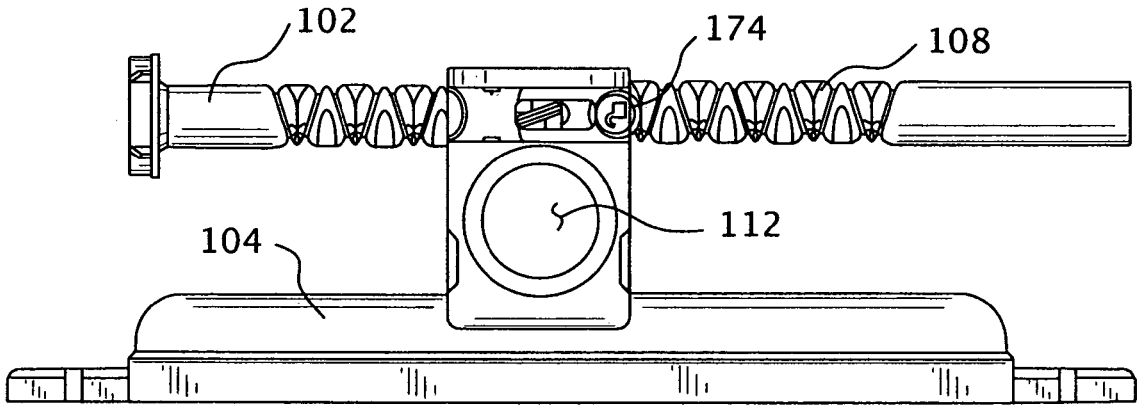
FIG. 9 is a front view of an autotrack device.
Figure 10:
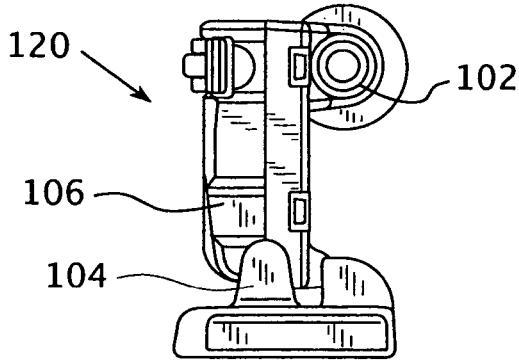
FIG. 10 is a side view of an autotrack device.

The autotrack device 100, shown in FIGS. 8-10, includes an elongated guide bar 102, an elongated retaining bar 104, and a follower assembly 106. The guide bar 102 and the retaining bar 104 extend in a spaced, parallel relation, and are, preferably, coupled to, and extending between, the housing assembly first lateral 24 side and second lateral side 28. The guide bar 102 has a bi-directional track groove 108 disposed thereon. The guide bar 102 is coupled by a mechanical drive system (not shown), such as, but not limited to, gears or a belt drive, to the barrel 42 or the crank assembly 50. The mechanical drive system is structured to rotate the guide bar 102 when the barrel 42 is rotated. The follower assembly 106 is coupled to, and extends between, the guide bar 102 and the retaining bar 104.

Figure 11:
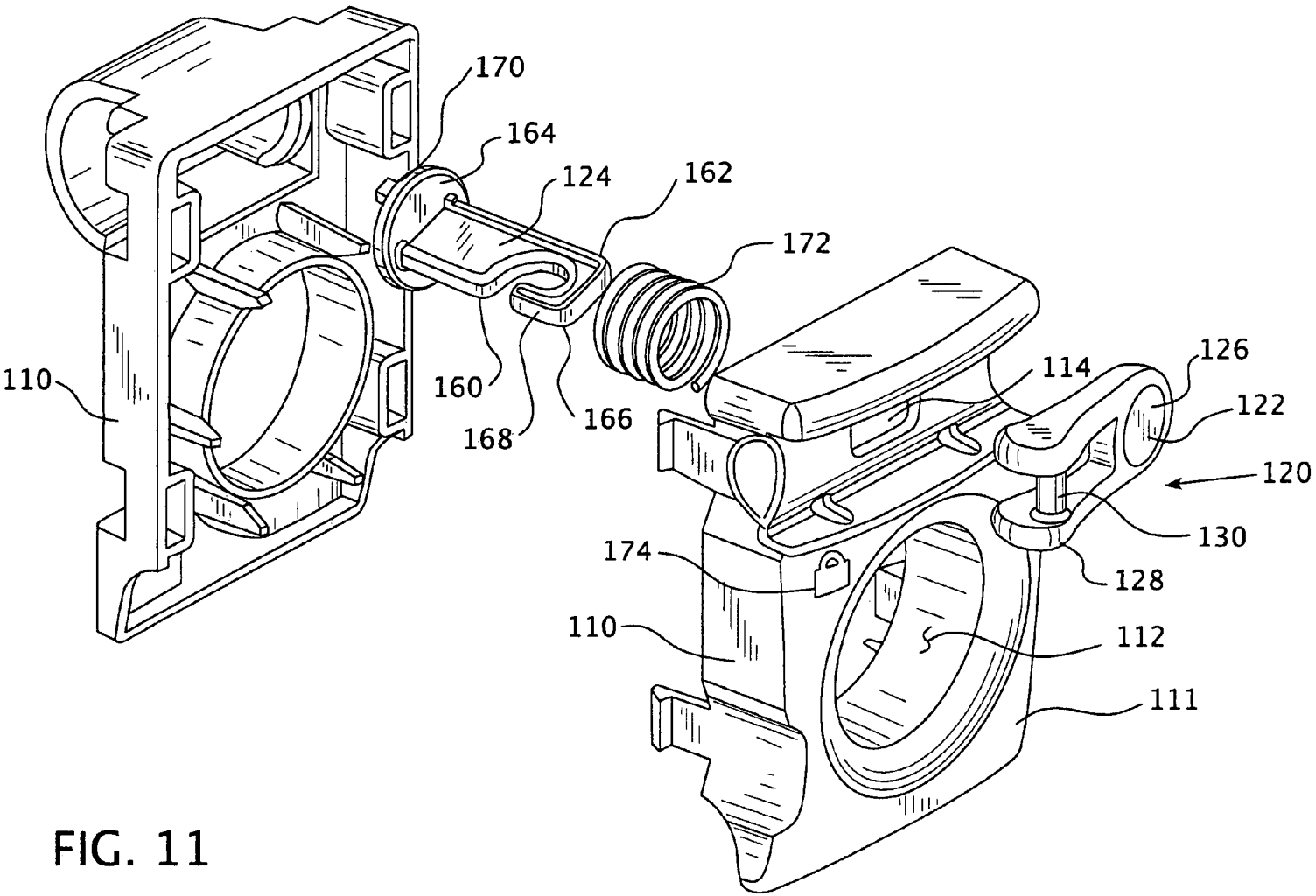
FIG. 11 is an exploded view of an autotrack follower.
Figure 12:
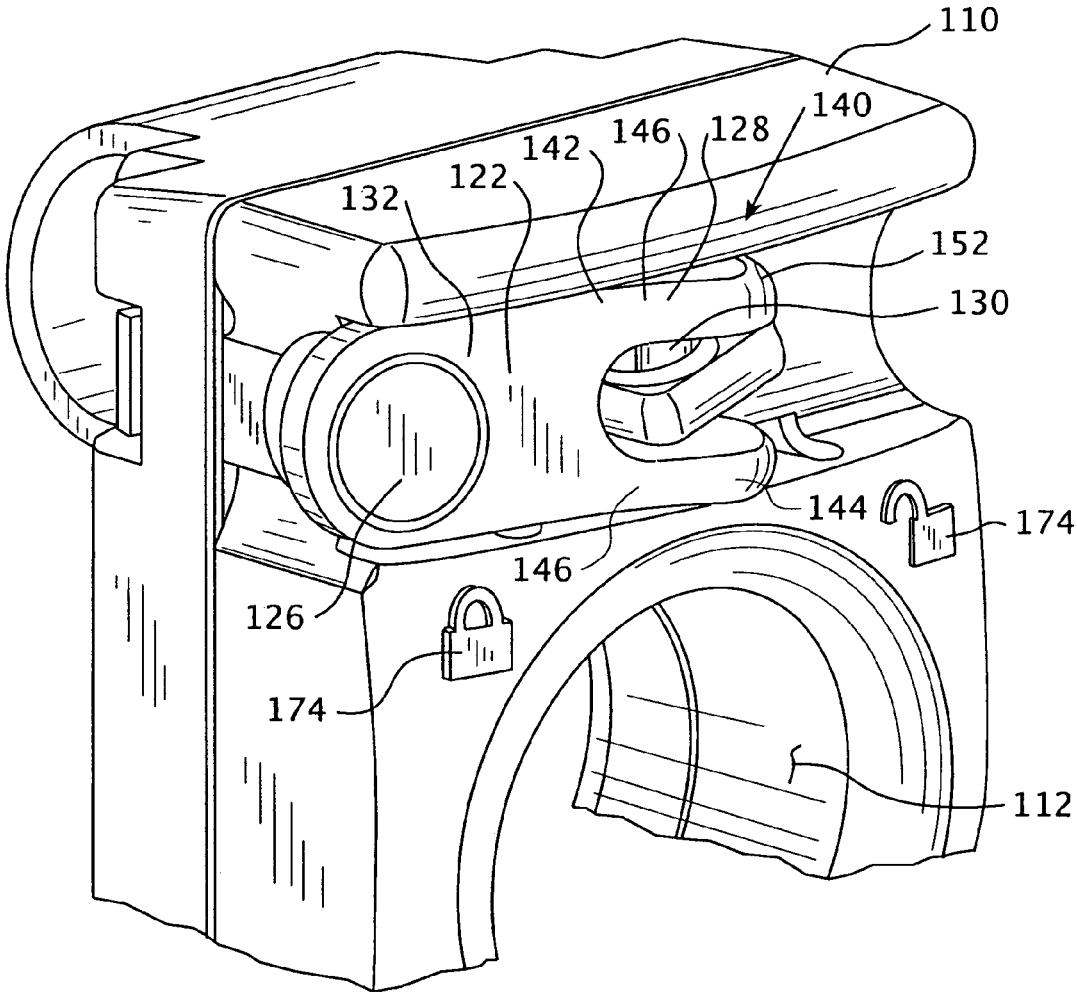
FIG. 12 is an isometric view of a lever in the first position.
Figure 13:
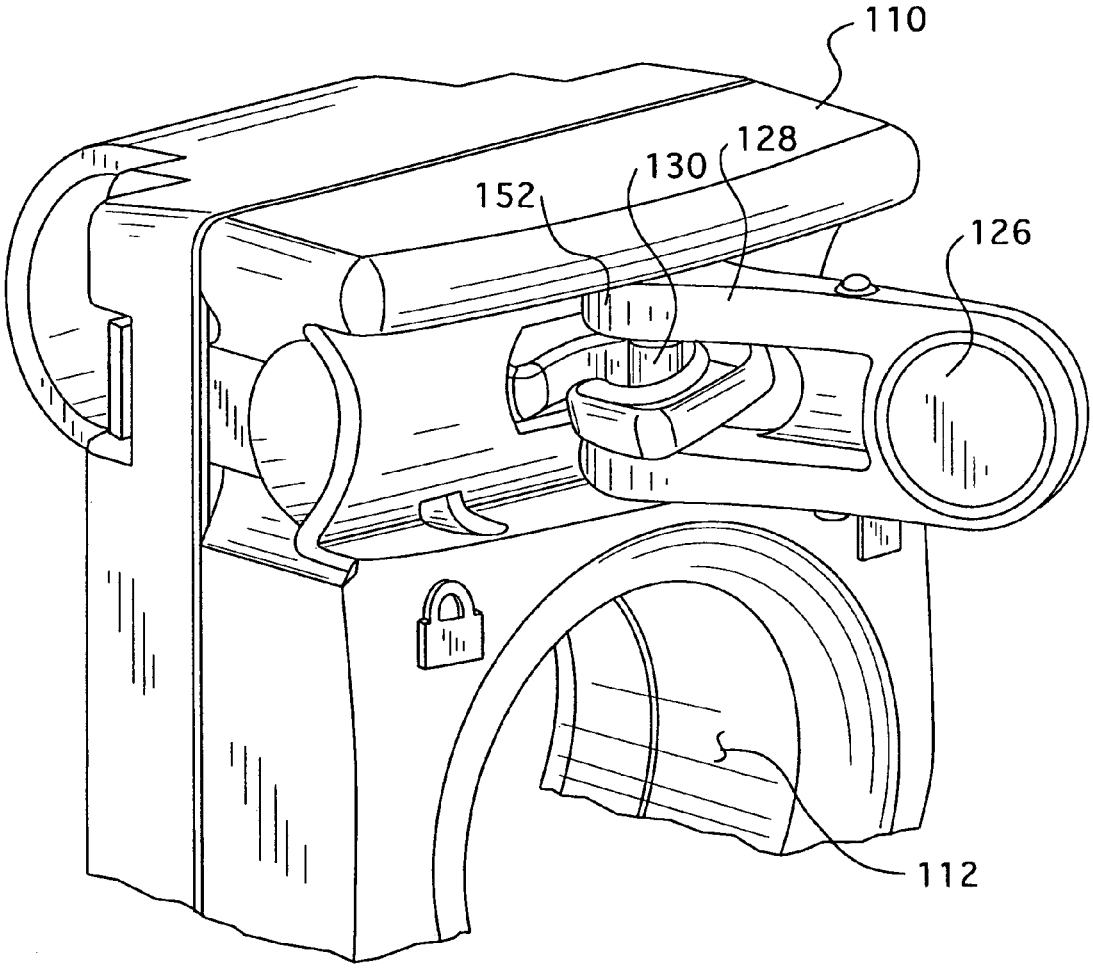
FIG. 13 is an isometric view of a lever between the first and second positions.
Figure 14:
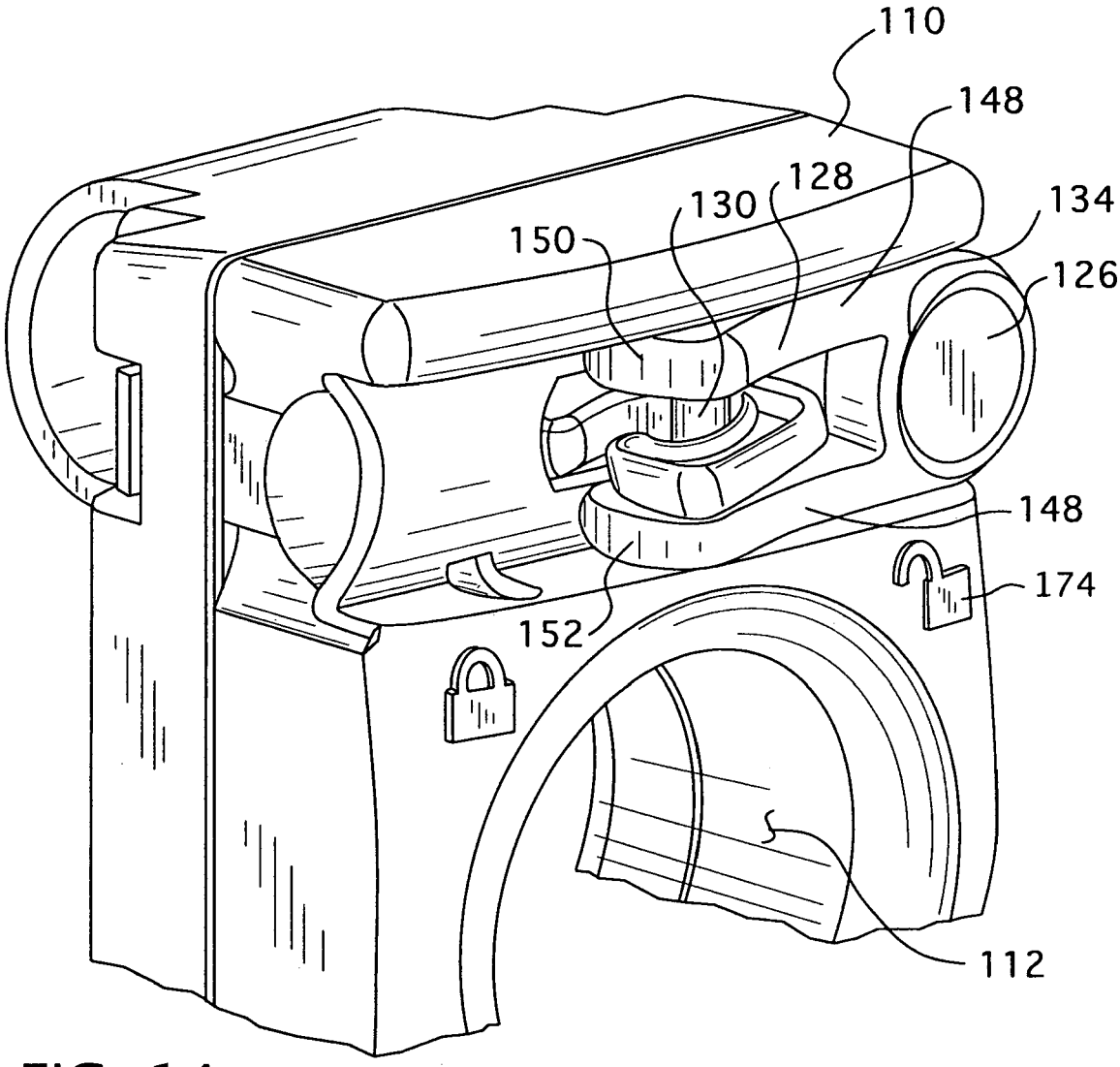
FIG. 14 is an isometric view of a lever in the second position.

The follower assembly 106 is structured to translate, that is, slide back and forth, between two positions on the guide bar 102 and the retaining bar 104, as described below. As shown in FIG. 11, the follower assembly 106 has a housing 110, with a first side 111, and a release lever assembly 120. The follower assembly housing 110 has a hose passage 112 therein sized to allow a hose (not shown) to pass therethrough and a track engaging member passage 114. Both the hose passage 112 and the track engaging member passage 114 extend, generally, in a direction perpendicular to the path of travel of the follower assembly housing 110. The release lever assembly 120 has an elongated lever member 122 and a track engaging member 124. As shown in FIGS. 12-14, the lever member 122 is pivotally coupled to the follower assembly housing 110. The lever member 122 has a grip portion 126, a cam portion 128, and an offset support rod 130. The grip portion 126 has a generally planar shape with a first face 132 (FIG. 12) and a second face 134 (FIG. 14). The cam portion 128 has a yoke 140 with two elongated tines 142 144. The cam portion tines 142, 144 extend from the grip portion 126. Each tine 142, 144 has a first face 146 (FIG. 12) and a second face 148 (FIG. 14), corresponding to said grip portion first face 132 and second face 134, as well as an end surface 150 extending between the tine first face 146 and second face 148 (FIG. 14). The cam portion 128 also has a cam surface 152 extending along each tine first face 146, end surface 150, and second face 148. The cam surface 152 is, preferably, bulged, that is, extending out of the plane of the grip portion 126, so that the cam surface 152 is an arcuate surface. The offset support rod 130 is disposed between the cam portion tines 142, 144. The offset support rod 130 is not disposed in the plane of the grip portion 126.

As shown in FIG. 11, the track engaging member 124 has an elongated body 160 with a first end 162 and a second end 164. The track engaging member first end 162 has a coupling device 166 structured to engage the offset support rod 130. In the preferred embodiment, the coupling device 166 structured to engage the offset support rod 130 is a hook 168. The track engaging member second end 164 has a tooth 170 structured to engage the track groove 108. A spring 172 is structured to be disposed between the track engaging member 124 and the follower assembly housing 110 and biases the track engaging member 124 toward the guide bar 102. An additional guide washer (not shown) may also be disposed between the spring 172 and the follower assembly housing 110.

When assembled, the autotrack device 100 is structured as follows. The follower assembly housing 110 is coupled to the guide bar 102 and the retaining bar 104 with the follower assembly housing first side 111 facing outwardly, that is, away from the guide bar 102 and the retaining bar 104. The track engaging member 124 is disposed between the follower assembly housing 110 and the guide bar 102 with the track engaging member first end 162 extending through the track engaging member passage 114 and extending to the follower assembly housing first side 111. That is, in the preferred embodiment, the hook 168 extends through the track engaging member passage 114. The spring 172 is disposed between the track engaging member 124 and the follower assembly housing 110 and biases the track engaging member 124 toward the guide bar 102. The lever member 122 is disposed on the follower assembly housing first side 111 with the hook 168 engaging the offset support rod 130. In this configuration, the spring 172 biases the track engaging member 124, and therefore the hook 168, away from the follower assembly housing first side 111. Thus, the hook 168 draws the offset support rod 130, and therefore the lever member 122 toward the follower assembly housing first side 111 and causes the cam surface 152 to engage the follower assembly housing first side 111. Additionally, the track engaging member tooth 170 is disposed adjacent to the track groove 108 and is structured to engage the track groove 108 as described below.

In this configuration, the lever member 122 and track engaging member 124 are movable between corresponding first positions, wherein the offset support rod 130 is disposed adjacent to the follower housing first side 111 and the track engaging member 124 engages said track groove 108, and second positions, wherein the offset support rod 130 is spaced from the follower housing first side 111 and the track engaging member 124 does not engage said track groove 108. That is, as shown in FIGS. 12-14, the release lever assembly 120 operates as follows. In a first position, shown in FIG. 12, the lever member 122 extends in one direction, to the left as shown. In this position, the offset support rod 130 is disposed adjacent to the follower housing first side 111 and the track engaging member 124, which is biased by the spring 172 toward the guide bar 102, engages the track groove 108. As shown in FIGS. 13 and 14, a user may pivot the lever member 122 approximately 180 degrees into the second position. As the lever member 122 is being pivoted, the cam surface 152 acts upon the follower housing first side 111 causing the lever member 122 to pivot about an imaginary pivot point. That is, the lever member 122 does not pivot about the offset support rod 130, but instead about a point extending through the center of the two elongated tines 142, 144. Further, as the pivot point for the lever member 122 does not correspond to the location of the offset support rod 130, the offset support rod 130 pivots through an arc. Thus, in the first position, the offset support rod 130 is disposed adjacent to the follower housing first side 111, but, as shown in FIG. 14, in the second position, the offset support rod 130 is space further away from the follower housing first side 111. As the track engaging member 124 is coupled to the offset support rod 130, the track engaging member 124 also moves in a direction generally perpendicular to the follower housing first side 111 between the first and second positions. The track engaging member tooth 170 is sized so that, when the track engaging member 124 is in the first position, the track engaging member tooth 170 is disposed in the track groove 108, and, when the track engaging member 124 is in the second position, the track engaging member tooth 170 is not disposed in the track groove 108. Additionally, the follower assembly 106 may include an indicia 174 indicating the status of the release lever assembly 120.

In operation, when the track engaging member tooth 170 is disposed in the track groove 108 and the barrel 42 is rotated, the track engaging member tooth 170, and therefore the track engaging member 124, travels axially along the guide bar 102. The motion of the track engaging member 124 is transferred to the follower assembly 106 which also travels axially along the guide bar 102. Thus, as a hose is being wound upon the barrel 42 and passing through the follower assembly 106, the hose is drawn back and forth thereby winding the hose on the barrel 42 in a controlled manner. A controlled manner of directing the hose is not required while drawing the hose outwardly. Accordingly, a user may simply flip the lever member 122 to the second position thereby separating the track engaging member tooth 170 from the track groove 108. In this position, the release lever assembly 120 is not engaged and the autotrack device is subject to a reduced amount of wear and tear.

Figure 15:
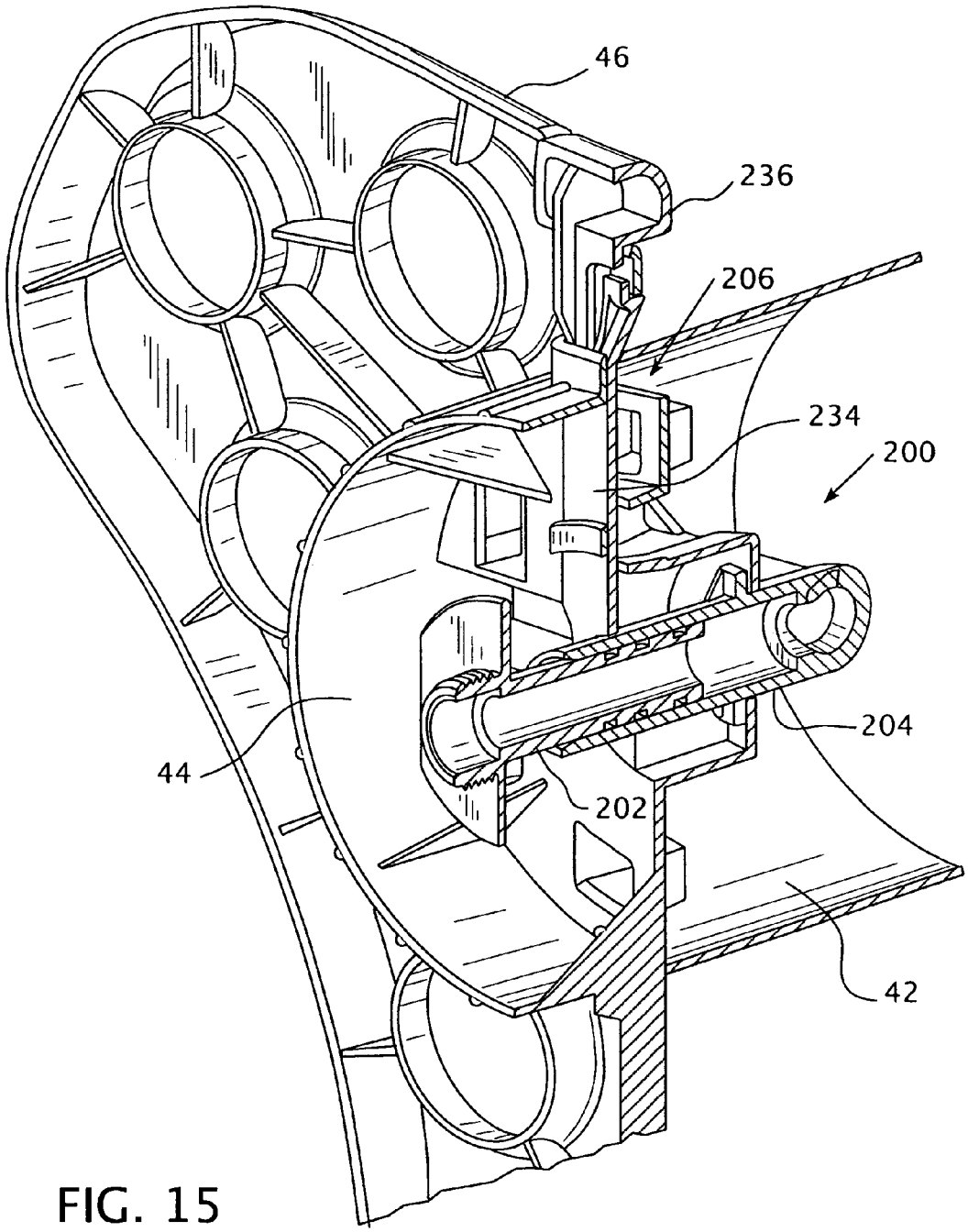
FIG. 15 is a cutaway view of the basket assembly.
Figure 16:
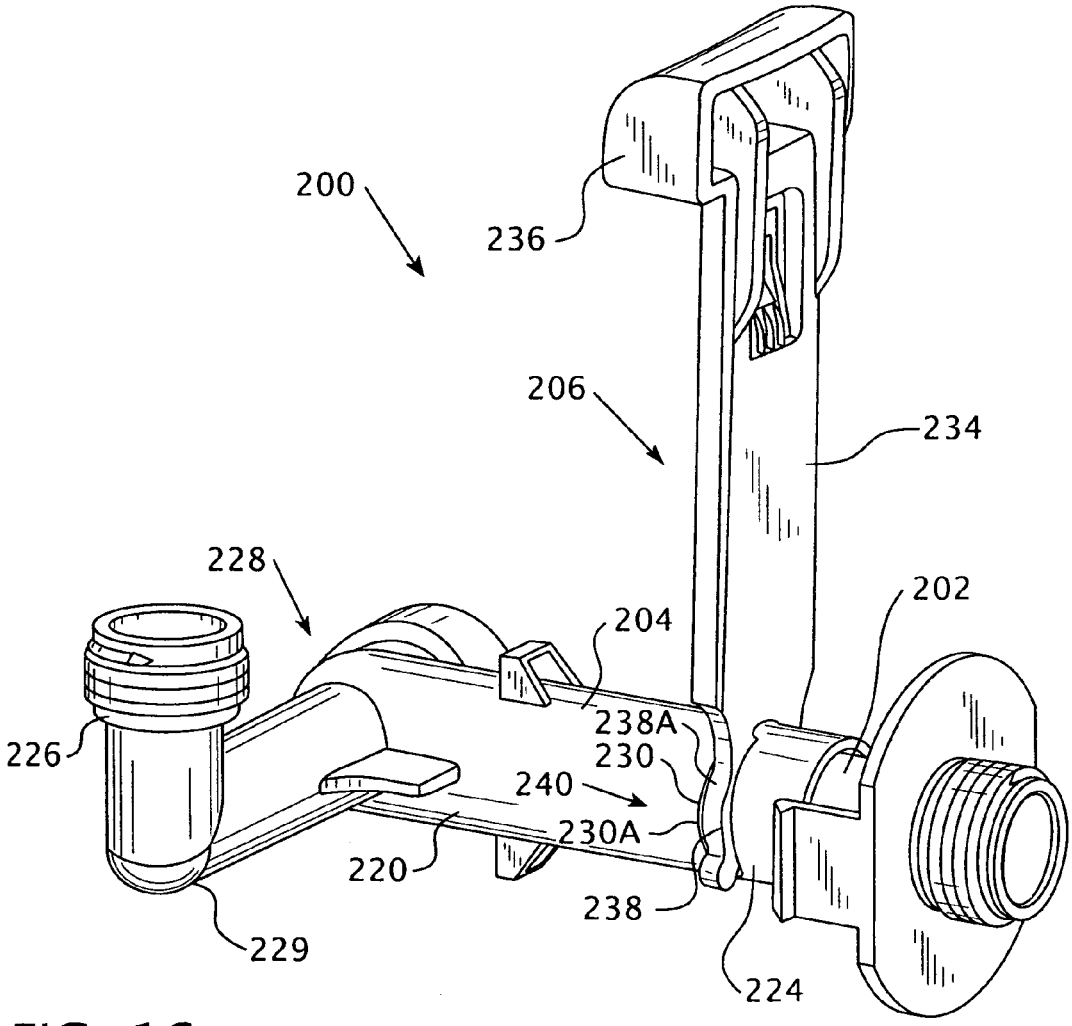
FIG. 16 is an isometric view of the water system.
Figure 17:
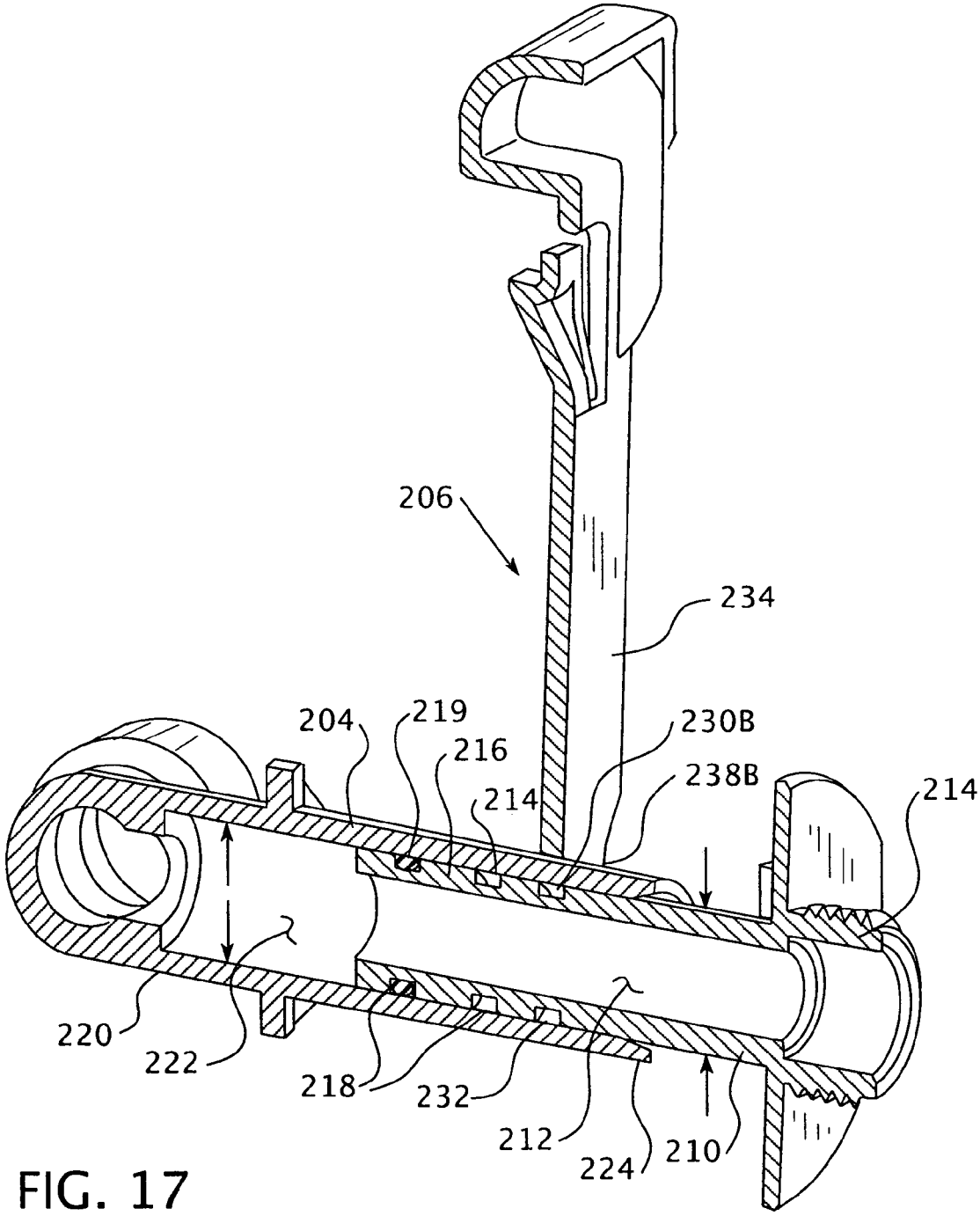
FIG. 17 is a cutaway view of the water system.

As shown in FIG. 15, the basket assembly 40 includes a water system 200 disposed partially within the barrel 42. As shown in FIGS. 16-17, the water system 200 includes an inlet member 202, an outlet member 204, and an interlock assembly 206. The inlet member 202 has a body 210 that is, preferably, an elongated, generally straight, circular body 210 defining an inlet member passage 212. The inlet member body 210 has a first, upstream end 214 and a second, downstream end 216. The inlet member body upstream end 214 may be threaded and structured to be coupled to a supply hose. The inlet member body 210 also has an outer diameter. The inlet member 202 is attached to the housing assembly 20 and does not rotate.

The outlet member 204 has a body 220 that is, preferably, an elongated circular body 220 defining an outlet member passage 222. The outlet member body 220 has a first, upstream end 224 and a second, downstream end 226 (FIG. 16). The outlet member body 220 also has a generally right angle bend 228 between the first, upstream end 224 and the second, downstream end 226, the outlet member body 220 further having an inner diameter, wherein the inner diameter is slightly larger than the inlet member body 210 outer diameter. The inlet member body downstream end 216 is structured to be partially disposed within the outlet member body upstream end 224. In this configuration, the inlet member passage 212 and the outlet member passage 222 are in fluid communication. The outlet member 204 is disposed substantially within, and is attached to, the barrel 42. Thus, the outlet member 204 rotates with the barrel 42. Further, the outlet member body downstream end 226, which extends through the barrel 42, may include an additional bend 229 so that the distal tip of the outlet member body downstream end 226 extends generally tangent to the surface of the barrel 42. The outlet member body downstream end 226 is, preferably, threaded and structured to be coupled to a hose.

As shown in FIG. 17, the inlet member 202 may include one or more O-ring grooves 218 disposed adjacent to the inlet member body downstream end 216 as well as one or more O-rings 219 structured to be disposed partially within the O-ring grooves 218. When the O-rings 219 are disposed within the O-ring grooves 218 and the inlet member body downstream end 216 is partially disposed within the outlet member body upstream end 224, the O-rings 219 engage both the inlet member 202 and the outlet member 204 and substantially prevent a fluid from passing through the gap between the inlet member 202 and the outlet member 204.

The interlock assembly 206 includes at least one opening 230 on the outlet member body 220, an interlock groove 232 on the inlet member body 210, and a removable, elongated locking member 234 having a handle portion 236 and at least one key member 238. The locking member 234 is structured to be coupled to the outlet member 204. When the inlet member 202 is disposed partially within the outlet member 204, the inlet member interlock groove 232 and the outlet member opening 230 are aligned. In this configuration, the locking member at least one key member 238 is structured to extend through the outlet member opening 230 into the inlet member interlock groove 232, thereby preventing said inlet member 202 moving a substantial distance axially relative to said outlet member 204. Further, the handle portion 236 is disposed on the outer surface of the basket assembly 40. In a preferred embodiment shown in FIG. 15, the basket assembly 40 includes two guide plates 46, 48 and the handle portion 236 extends and conforms to the shape of a guide plate 46, 48. The locking member 234 may be removed by pulling on the handle portion 236 and moving the locking member 234 radially relative to the outer member 204. In the preferred embodiment, the locking member 234 includes two key members 238A, 238B which form a yoke 240 extending from the handle portion 236. Further, the outlet member body 220 has two aligned and opposed arcuate openings 230A, 230B.

In this configuration, a user may easily separate the inlet member 202 and the outlet member 204 by removing the locking member 234 and separating the inlet member 202 and the outlet member 204 axially. That is, once the locking member 234 has been removed, the user simply pulls the inlet member 202 out of the outlet member 204. The user may further recouple the inlet member 202 and the outlet member 204 by inserting the inlet member body downstream end 216 partially within the outlet member body upstream end 224 until the outlet member opening 230 is aligned with the inlet member interlock groove 232. When the outlet member opening 230 is aligned with the inlet member interlock groove 232, the locking member 234 may be reinstalled by moving the at least one key member 238 through the outlet member opening 230 into the inlet member interlock groove 232.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A hose reel assembly comprising:

a housing assembly;

a basket assembly structured to be rotatably coupled to said housing assembly, said basket assembly having an elongated barrel with two axial hubs, and a crank assembly, said crank assembly coupled to said barrel and structured to rotate said barrel relative to said housing assembly;

said crank assembly having a crank arm and a handle assembly;

said crank arm having a handle pocket and a handle receptacle;

said handle receptacle having at least one pivot opening and at least one locking edge;

said handle pocket having at least one finger notch adjacent to said pivot opening;

said handle assembly having a handle member with a distal end and a receptacle end, said receptacle end having at least one pivot pin and at least one locking tab;

wherein said handle assembly is pivotally coupled to said crank arm with said receptacle end at least one pivot pin coupled to said receptacle end at least one pivot opening, said handle assembly structured to move between a first, folded position, wherein said handle assembly is disposed partially within said handle pocket, and a second, extended position wherein said handle assembly extends about ninety degrees to said crank arm and, when said handle assembly is in said second, extended position, said locking tab engages said at least one locking edge; and wherein said at least one locking tab is structured to be generally biased to a locked position, wherein said at least one locking tab engages said at least one locking edge, but is movable to a released position, wherein said at least one locking tab does not engage said at least one locking edge, said locking tab being accessible via said at least one finger notch.

2. The hose reel assembly of claim 1 wherein:

said at least one locking tab includes an elongated stein, a locking surface extending generally perpendicular to said stem, and a finger pad;

said stem having a first, proximal end and a second, distal end, said proximal end coupled to said receptacle end, said locking surface and said finger pad disposed adjacent to said distal end;

wherein said second distal end is structured to flex relative to said first proximal end; and wherein said locking surface is structured to engage said at least one locking edge.

3. The hose reel assembly of claim 2 wherein said receptacle end includes a stop tab, said stop tab being structured to engage said handle receptacle when said handle assembly is in said second, extended position.

4. The hose reel assembly of claim 1 wherein:

said at least one pivot opening is two pivot openings disposed along a common axis;

said at least one pivot pin is two pivot pins, each said pivot pin structured to engage one of said pivot openings;

said at least one locking edge is two locking edges, each locking edge disposed adjacent to one of said pivot openings;

said at least one locking tab is two locking tabs, each said locking tab structured to engage one of said locking edges; and said at least one finger notch is two finger notches, each said finger notch disposed adjacent to one of said pivot openings.

5. The hose reel assembly of claim 4 wherein:

said each said locking tab includes an elongated stem, a locking surface extending generally perpendicular to said stem, and a finger pad;

each said stem having a first, proximal end and a second, distal end, each said proximal end coupled to said receptacle end, each said locking surface and each said finger pad disposed adjacent to said distal end;

wherein each said second distal end is structured to flex relative to said first proximal end; and wherein each said locking surface is structured to engage said adjacent locking edge.

6. The hose reel assembly of claim 1 wherein:

said housing assembly includes a front side, back side, first lateral side, a second lateral side, and an autotrack device;

said autotrack device having an elongated guide bar, an elongated retaining bar, and a follower assembly;

said guide bar having a bi-directional track groove disposed thereon;

said guide bar and said retaining bar extending in a spaced parallel relation, both said guide bar and said retaining bar being coupled to, and extending between, said housing assembly first lateral side and said housing assembly second lateral side;

said follower assembly coupled to, and extending between, said guide bar and said retaining bar;

said follower assembly having a housing and a release lever assembly;

said follower housing having an opening therein sized to allow a hose to pass therethrough;

said release lever assembly having an elongated lever member and a track engaging member;

said lever member being pivotally coupled to said follower housing and having an arcuate cam surface and an offset support rod;

said track engaging member structured to engage said offset support rod and said track groove; and wherein said lever member and track engaging member are movable between corresponding first positions, wherein said offset support rod is disposed adjacent to said follower housing and said track engaging member engages said track groove, and second positions, wherein said offset support rod is spaced from said follower housing and said track engaging member does not engage said track groove.

7. The hose reel assembly of claim 6 wherein:

said lever member includes a grip portion and a cam portion;

said cam surface being disposed on said cam portion;

said grip portion having a generally planar shape having a first face and a second face;

said cam portion being a yoke having two elongated tines, said tines extending from said grip portion;

each said tine having a first face and a second face, corresponding to said grip portion first face and second face, and an end surface extending between each said tine first face and second face; and said cam surface extending along each said tine first face, end surface, and second face.

8. The hose reel assembly of claim 7 wherein said offset support rod is disposed between said two tines, said offset support rod not being disposed in the plane of said grip portion.

9. The hose reel assembly of claim 7 wherein:

said autotrack device includes a spring; and said spring disposed between said track engaging member and said follower assembly housing so that said track engaging member is biased toward said guide bar.

10. The hose reel assembly of claim 7 wherein:

said track engaging member has an elongated body with a first end and a second end, said first end having a coupling device structured to engage said offset support rod and said second end having a tooth structured to engage said track groove;

said track engaging member coupling device coupled to said offset support rod; and wherein said tooth engages said track groove when said track engaging member is in said first position and said tooth does not engage said track groove when said track engaging member is in said second position.

11. The hose reel assembly of claim 6 wherein:

said lever member includes a grip portion and a cam portion;

said cam surface being disposed on said cam portion;

said grip portion having a generally planar shape having a first face and a second face;

said cam portion being a yoke having two elongated tines, said tines extending from said grip portion;

each said tine having a first face and a second face, corresponding to said grip portion first face and second face, and an end surface extending between each said tine first face and second face; and said cam surface extending along each said tine first face, end surface, and second face.

12. The hose reel assembly of claim 1 wherein:

said basket assembly includes a water system, said water system having an inlet member, an outlet member, and an interlock assembly;

said inlet member coupled to said housing assembly, said inlet member having a body defining a passage, said inlet member body having an outer diameter;

said outlet member coupled to said basket assembly, said outlet member having a body defining a passage, said outlet member body further having an inner diameter, said inner diameter being slightly larger than said inlet member outer diameter;

said interlock assembly including at least one opening on said outlet member body, an interlock groove on said inlet member body, and a removable, elongated locking member having a handle portion and at least one key member, said locking member structured to be coupled to said outlet member; and wherein, when said inlet member is disposed partially within said outlet member, said inlet member interlock groove and said outlet member opening are aligned and said locking member at least one key member extends through said outlet member opening into said inlet member interlock groove, thereby preventing said inlet member moving a substantial distance axially relative to said outlet member, and said handle portion being disposed on the outer surface of said basket assembly.

13. The hose reel assembly of claim 12, wherein:

said inlet member body is an elongated, generally straight, circular body defining said inlet member passage, said inlet member body having a first, upstream end and a second, downstream end;

said outlet member body is an elongated circular body defining said outlet member passage, said outlet member body having a first, upstream end and a second, downstream end, said body having a generally right angle bend between said first, upstream end and said second, downstream end;

said inlet member body first, upstream end is disposed on the outer side of said housing assembly, said inlet member body second, downstream end extends into said outlet member body first, upstream end; and said outlet member body first, upstream end is disposed in said barrel and said outlet member body second, downstream end extends to the outside of said barrel.

14. The hose reel assembly of claim 12 wherein:

said locking member includes two key members, said key members forming a yoke extending from said handle portion; and said outlet member body having two aligned and opposed openings.

15. The hose reel assembly of claim 14 wherein:

said key members include an arcuate portion structured to extend into said outlet member body openings; and said outlet member body openings being elongated arcuate openings.

16. The hose reel assembly of claim 12 wherein:

said basket assembly includes at least one guide plate having an outer edge; and said locking member handle portion structured to extend to said guide plate outer edge.

17. The hose reel assembly of claim 12 wherein:

said locking member handle portion includes a clip structured to engage said guide plate and thereby maintain said locking member in place relative to said guide plate.

* * * * *

UNITED STATES PATENT AND TRADEMARK OFFICE

CERTIFICATE OF CORRECTION

PATENT NO. : 7,377,289 B1
APPLICATION NO. : 11/385206
DATED : May 27, 2008
INVENTOR(S) : Stephen T. English et al.

It is certified that error appears in the above-identified patent and that said Letters Patent is hereby corrected as shown below:

Column 1, line 33, “While manufactures try” should be --While manufacturers try--.
Column 1, line 37, “manufactures try” should be --manufacturers try--.
Column 1, lines 42-43, “some manufactures” should be --some manufacturers--.
Column 2, line 55, “ann” should be --arm--.
Column 3, line 29, “the grove aligned” should be --the groove aligned--.
Column 7, line 27, “is space further” should be --is spaced further--.

Signed and Sealed this

Second Day of December, 2008

JON W. DUDAS
*Director of the United States Patent and Trademark Office*